US005456459A

United States Patent [19]

Gorman

[11] Patent Number: 5,456,459

[45] Date of Patent: Oct. 10, 1995

[54] DEFLECTABLE BASKETBALL GOAL

[76] Inventor: Jeremy P. Gorman, 219 Serpentine Rd., Albany 6330, Western, Australia

[21] Appl. No.: 194,656

[22] Filed: Feb. 10, 1994

[30] Foreign Application Priority Data

Feb. 10, 1993 [AU] Australia ..... PL7211

[51] Int. Cl.[6] ..... A63B 63/08

[52] U.S. Cl. ..... 273/1.5 R

[58] Field of Search ..... 273/1.5 RA

[56] References Cited

U.S. PATENT DOCUMENTS 4,111,420 9/1978 Tyner .
4,365,802 12/1982 Ehrat .
4,534,556 8/1985 Estlund et al. .
4,676,503 6/1987 Mahoney et al. .

*Primary Examiner*—Paul E. Shapiro
*Attorney, Agent, or Firm*—Larson and Taylor

[57] ABSTRACT

A deflectable basketball goal (10) having a mounting assembly (12) which sets a bracket (62) of a ring assembly (16) at a small angle to the vertical so as to allow a less abrupt actuation of a biasing assembly (18). Accordingly, load applied to the ring assembly (16) is more gradually applied to a basketball backboard to which the deflectable basketball goal (10) is attached. A pivot assembly (14) has resilient members (44 and 46) so as to accommodate slight wobble in the ring assembly (16) for avoiding the effects of wear and hence giving the deflectable basketball goal (10) more consistent "lip out" or rebound characteristics overtime.

10 Claims, 3 Drawing Sheets

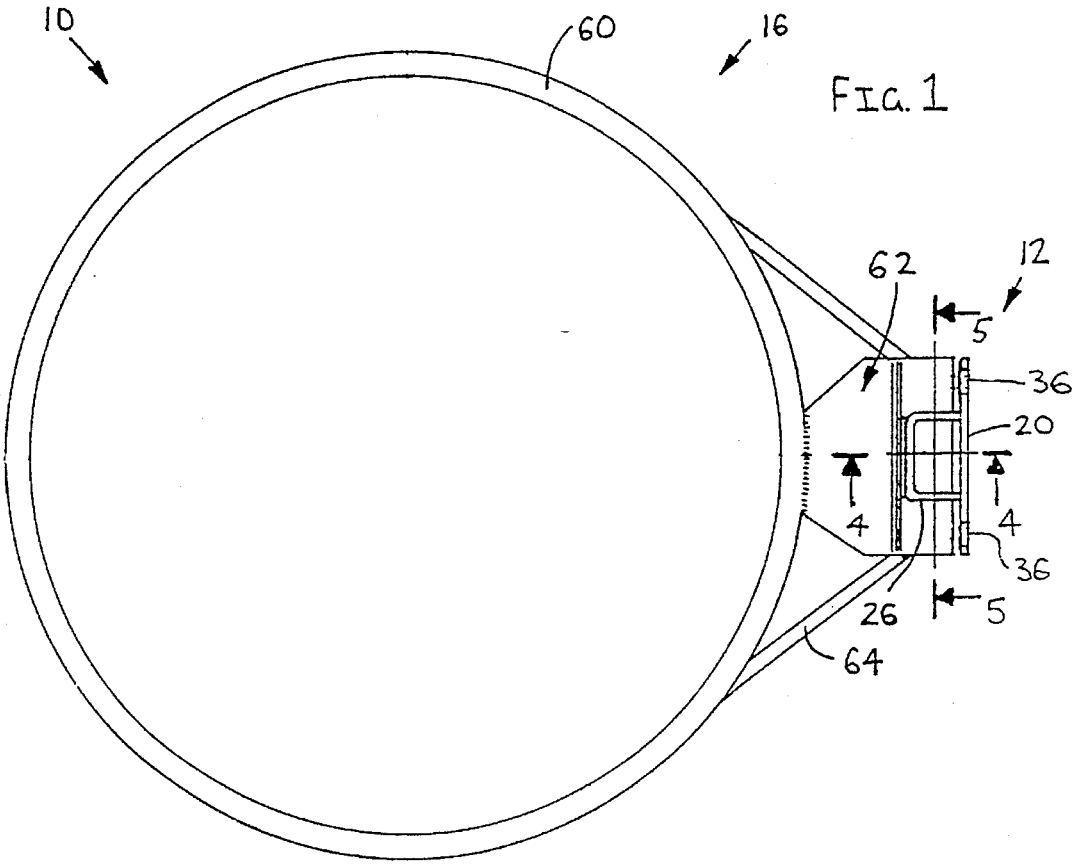
FIG. 1
FIG. 2
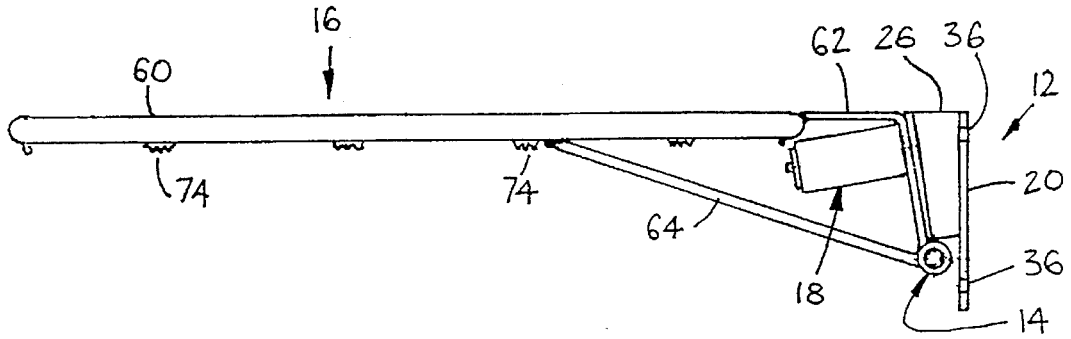
FIG. 3
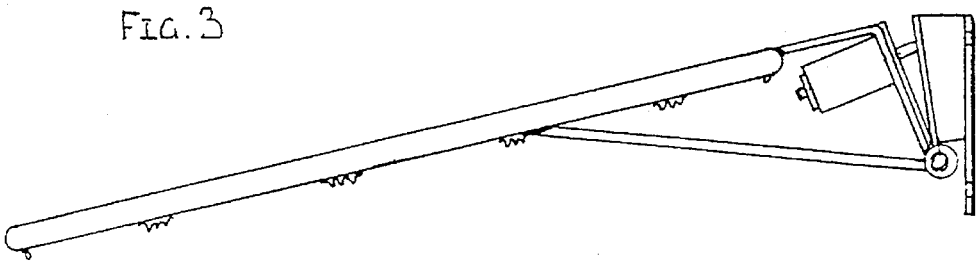

DEFLECTABLE BASKETBALL GOAL

FIELD OF THE INVENTION

The present invention relates to a deflectable basketball goal and a net therefore.

BACKGROUND OF THE INVENTION

It has become relatively common practice to use deflectable or break-away basketball goals in higher grade and professional basketball leagues. These are typified in U.S. Pat. Nos. 4,676,503, 4,534,556, 4,365,802 and 4,111,420. The deflectable basketball goals have a NORMAL USE position in which their ring assembly is substantially horizontal and a DEFLECTED POSITION wherein the ring assembly is deflected downwardly up to about 200 mm measured at the free end of the ring assembly. The purpose of the deflection is to reduce the strain placed upon a basketball backboard to which the deflectable basketball goal is attached.

Early in the development of the game of basketball is was rare for players to reach the ring assembly of the basketball goals. As time passed and players developed their height and skill they started to make contact with the rang assembly. Such contact was penalised by a technical foul so as to discourage the contact and thereby protect the ring assembly and the basketball backboard.

Then ring assemblies were modified to pivot down to a non-use position if struck with greater than a predetermined force—and so was developed the "break-away" basketball goal. The problem of the break-away basketball goal was that it had to be manually reset which delayed play and detracted from the speed of the basketball game. Hence, designers created break-away basket ball goals which automatically reset once the load was removed. Also, the spectators began to expect players to make contact with the basketball ring in what has become known as a "slam dunk".

In the past few years players have placed increasing loads on basketball goals by the use of the slam dunk. Typically, a slam dunk, as now performed, can place a load of about 150 kg or more onto the ring assembly of the basketball goal. Many of the basketball goals developed in the last 15 years are simply not capable of sustaining such a load and can not protect the basketball backboard from the effect of the impact of that load even though they were developed with the protection of the basketball backboard in mind. For example, the basketball goals of U.S. Pat. Nos. 4,111,420, 4,365,802 and 4,534,556 are not suited to accommodate such loads—even if heavier gauge springs were used. The reason for this is that these basketball goals were not designed with such loads in mind, so the basketball goals tend to fail prematurely and the basketball backboards receive too little protection from the effects of such loads.

The basketball goal of U.S. 4,111,420 has the disadvantage that a bolt upon which a return spring is mounted must pivot at its connection to a bracket pivoted to the basketball backboard. This has the effect of shortening the life of the bolt, causing it to wear irregularly and causing an uneven rate and direction of return of its basketball ring from the deflected position to the normal use position.

This problem is attempted to be overcome in U.S. Pat. No. 4,365,802 by using a cable in place of the bolt. However, the structure of U.S. Pat. No. 4,365,802 can not be made sufficiently robust to cope with the amount of load that basketball players now place on basketball goals.

In U.S. 4,534,556 the bolt wear problem is attempted to be overcome by using a curved-belt carrying a compression spring or the use of a tension spring which does not have a guiding bolt. The former has the disadvantage that the spring must be very stiff to absorb the load and hence tends to wear against the curved surface of the bolt. The latter has the disadvantage that the mounting for the goal must pass through or beneath the basketball backboard and does not comply with international regulations concerning basketball goals.

In U.S. 4,676,503 a large number of embodiments of break-away basketball goals are disclosed, each of which fail to address the problems of coping with the large loads to which basketball goals are now subjected.

Also, a further problem is that prior art deflectable basketball backboards tend wear with use and their pivot mechanisms become sloppy which causes a change overtime in the characteristics of the basketball goal in relation to "lip out" or rejection of a basketball. Typically, conventional deflectable basketball goals increase the likelihood of "lip out" over time as the pivot mechanism wears of a basketball which strikes the ring assembly due to increased jarring and wobble of the ring assembly. The varying degree to which the enhanced "lip out" phenomenon occurs with wear becomes a measure of whether basketball players like or dislike the deflectable basketball goal. In many cases latch mechanisms are used to attempt to overcome the effect of vibration of the ring assembly when struck by a basketball. However, the latches inherently lead to abruptness in the transfer of load to the basketball backboard when the ring assembly springs back.

The most significant problem with prior art deflectable and break-away basketball goals is that due to the orientation of their return springs there is an abrupt transfer of load on the goal, such as by players performing a "slam dunk". This abrupt transfer of load tends to defeat the very purpose the deflectable and break-away basketball goals were developed—namely to reduce the impact of the load transference experienced by the basketball backboard.

SUMMARY OF THE INVENTION

I have discovered that by orienting a bias spring of the deflectable basketball goal slightly downwardly better load transfer characteristics result.

Therefore, it is an object of the present invention to provide a deflectable basketball goal which protects the basketball backboard, is robust and has more consistent "lip out" characteristics overtime.

In accordance with one aspect of the present invention there is provided a deflectable basketball goal for attachment onto a basketball backboard, the deflectable basketball goal comprising:

a ring assembly having a ring member fixed to a bracket;

a mounting means securable onto the basketball backboard for inclining the bracket at an acute angle to the vertical;

a pivot assembly disposed substantially horizontally and coupling the bracket to the mounting means for pivotably supporting the ring assembly, the pivot assembly allowing pivoting of the ring assembly between a normal use position and a deflected position; and, a biasing assembly attached between the mounting means and the brackets, the biasing assembly allowing pivoting of the ring assembly upon the mounting means against a resilient restoring force, the biasing assembly acting in a direction substantially at right angles to the angle of inclination of the bracket;

whereby, in use, load is relatively smoothly transferred from the ring assembly to the basketball backboard by the biasing assembly and the pivot assembly.

Typically, the pivot assembly has resilient means for allowing resilient non-axial movement of the ring member.

Another problem prevalent with prior art basketball goals is the nature of the basketball net use therewith. Basketball nets are formed from chord tied or woven into a net type configuration. The chord used is relatively stiff and the net formed such that an outlet end of the net is narrower than the diameter of the basketball which is to pass through it. Hence, the outlet end is stretched each time a basketball passes through the net. The purpose of the net is primarily to indicate that the basketball has travelled through the ring assembly thereby indicating the scoring of a "goal".

However, conventional basketball nets suffer two problems. Firstly, with use the chord from which the basketball net is made looses its stiffness and hence the basketball net looses its resilience and becomes substantially cylindrical along its length from the ring assembly downward. The net then fails to accurately indicate whether the basketball travelled through the ring assembly and through the basketball net or whether the basketball missed the ring assembly entirely but flicked the basketball net. Secondly, the basketball net tends to wear due to movement of the net at its connection with the ring assembly created by the passage of the basketball through the basketball net.

In accordance with another aspect of the present invention there is provided a basketball net for attachment to a ring member of a basketball goal to indicate the passage of a basketball through the basketball goal, the basketball net having:

a first end attachable to the ring member, the first end being configured for allowing passage of the basketball through it; and, a second end disposable below the first end, the second end having a plurality of loops, the loops each being applied with a coating for rendering the loops substantially resilient, the second end being narrower in diameter than the basketball but which can be stretched by the basketball for retarding the speed of passage of the basketball through the net.

It is a further object of the present invention to provide a basketball net which exhibits better wear characteristics.

In accordance with a further aspect of the present invention there is provided a basketball net for attachment to a ring member of a basketball goal to indicate the passage of a basketball through the basketball goal, the basketball net having:

a first end with a plurality of loops for attachment to the ring member, the first end being configured for allowing passage of the basketball through it; and, a second end which is disposable below the first end, when in use, and which is narrower in diameter than the basketball but which can be stretched by the basketball for retarding the speed of passage of the basketball through the net;

wherein the plurality of loops at the first end each have a high friction coating applied to them for inhibiting movement of the net with respect to the ring member at the attachment of the net to the ring member.

BRIEF DESCRIPTION OF THE DRAWINGS

An exemplary embodiment the present invention will now be described with reference to the accompanying drawings in which:

FIG. 1 is a plan view of a deflectable basketball goal in accordance with the present invention;

FIG. 2 is a side view of the deflectable basketball goal of FIG. 1, shown in a NORMAL USE position;

FIG. 3 is a side view of the deflectable basketball goal of FIG. 1, shown in a DEFLECTED POSITION;

DESCRIPTION OF THE PREFERRED EMBODIMENTS

Figure 4:
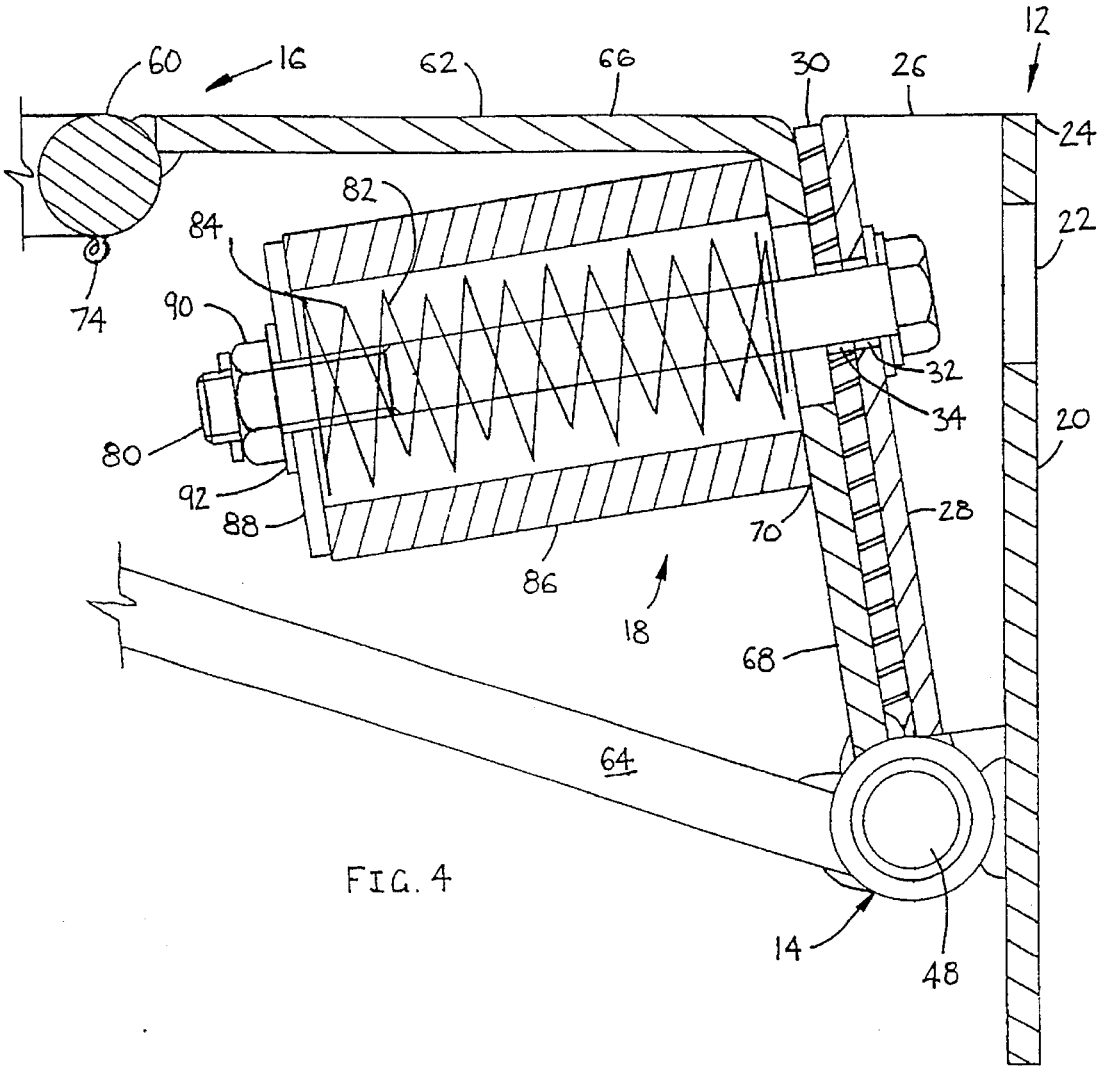
FIG. 4 is a cross-sectional side view of the deflectable basketball goal of FIG. 1, shown in the vicinity of a mounting assembly.

In FIGS. 1 to 3 there is shown a deflectable basketball goal 10 comprising a mounting assembly 12, a pivot assembly 14, a ring assembly 16, and a biasing assembly 18.

Particularly as shown in FIG. 4 the mounting assembly 12 comprises a mounting plate 20 having a hole 22 located adjacent its upper end 24, and a wedge member 26. The wedge member 26 has a front face 28 which diverges from the mounting plate 20 towards the upper end 24 at an angle of between 5° and 15°, such as approximately 9°. Located contiguous with the front face 28 is a dimensionally stable damper 30 typically made from conveyor belt material or polypropylene rubber. The front face 28 has a hole 32 which overlies a hole 34 in the damper 30. Particularly as shown in FIGS. 1 and 2 the mounting plate 20 has mounting hole 36 for receiving bolts for fixing the mounting assembly 2 to a basketball backboard.

Figure 5:
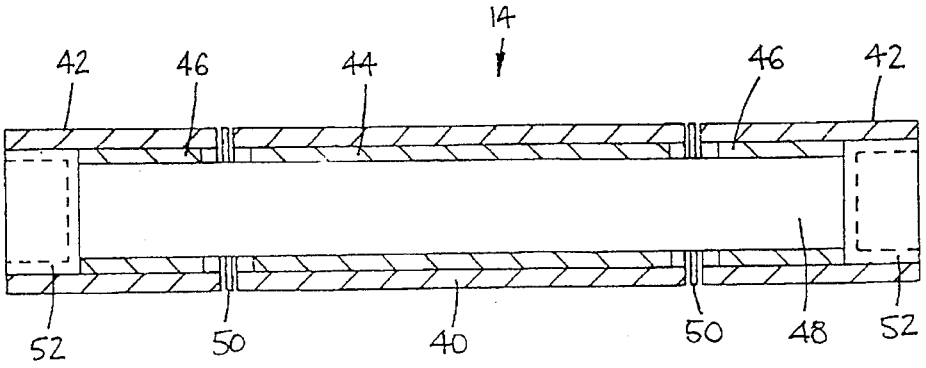
FIG. 5 is a cross-sectional front view of pivot assembly of the delectable basketball goal of FIG. 1; and, FIG. 6 is a side view of a basketball net in accordance with the present invention and which is suitable for use with the deflectable basketball goal of FIG. 1.

Particularly as shown in FIGS. 4 and 5 the pivot assembly 14 comprises a base member 40, two pivot member 42, compressible tubes 44 and 46 and a shaft 48. The base member 40 is typically welded to the mounting plate 20 and the front face 28 below the wedge member 26 and the pivot members 42 are conveniently welded to the ring assembly 16. The tubes 44 and 46 are located upon the shaft 48 which provides a common pivot for the base member 40 and the pivot members 42. The tubes 46 are coaxial with the pivot members 42, whilst the tube 44 is coaxial with the base member 40 and located between the two tubes 46. Washers 50 are located between the base member 40 and the pivot members 42 so as to prevent the tubes 44 and 46 moving axially upon the shaft 48. Typically, the tubes 44 and 46 are made from polyurethane hose pipe such as that sold under registered trade mark NYLEX. The tubes 44 and 46 have the effect of compressing slightly to absorb vibrations between the ring assembly 16 and the mounting assembly 12. This reduces the wear in the pivot assembly 14 and hence makes the "lip-out" characteristics of the deflectable basketball goal 10 more consistent over time.

Conveniently, core plugs 52 (shown in phantom) may be forced into the ends of the pivot members 42 so as to retain the shaft 48 axially within the base member 40 and the pivot members 42.

Particularly, as shown in FIGS. 1, 2 and 4 the ring assembly 16 comprises a ring member 60, a bracket 62 and two braces 64. The ring member 60 is substantially circular in plan and is dimensioned to receive a basketball. Typically, the ring member 60 is formed from circular metal rod bent into a ring shape. The bracket 62, as shown in FIG. 4, has a top 66 and a back face 68. The back face 68 is at an angle of between 95° to 105°, such as, approximately 99° to the top 66. The top 66 is conveniently welded to an outer edge of the ring member 60 and disposed substantially coplanar with the ring member 60. The back face 68 i disposed downwardly from the ring member 60 and is conveniently welded to the pivot members 42 of the pivot assembly 14. The back face 68 of the bracket 62 is disposed to lie contiguous with the damper 30. Also, the back face 68 has a hole 70 which is located coaxially with holes 32 and 34. The braces 64 are welded between the ring member 60 and the pivot members 42. Preferably, the braces 64 extend approximately ⅓ of the diametrical distance measured from the connection of the top 66 to the ring member 60. Accordingly, the braces 64, particularly as shown in FIG. 1, underlie the ring member 60 and hence avoid fouling of the basketball whilst providing considerable support and rigidity for the ring member 60.

The ring member 60 also has a plurality of net hangers 74 for coupling a basketball net 76 (see FIG. 6) to the ring assembly 16.

The biasing assembly 18, particularly as shown in FIG. 4, comprises a bolt 80, two springs 82 and 84, a shield 86 and a retaining disk 88. The bolt 80 is located through the holes 32, 34 and 70 and is disposed substantially towards the ring member 60 from the mounting plate 20. The two springs 82 and 84 are located one within the other and are located coaxially upon the bolt 80. Two springs 82 and 84 are used in order to provide a relatively large force biasing the ring assembly 16 towards a NORMAL POSITION as shown in FIG. 2 and away from a DEFLECTED POSITION as shown in FIG. 3. The shield 86 is located about the outer spring 82, and the retaining disk 88 retains both of the springs 82 and 84 and the shield 86 upon the bolt 80. A biasing nut 90 and a washer 92 maintain the retaining disk 88 upon the bolt 80. The biasing nut 90 is threaded onto the bolt 80 a predetermined distance so as to compress the springs 80 and 82 to provide a predetermined biasing force between the retaining disk 88 and the back face 68 o the bracket 62. Accordingly, the biasing assembly 18 provides a predetermined amount of force urging the bracket 62 against the damper 30. It is to be noted that the bolt 80 is at an angle to the horizontal of between 5° to 15°, such as, approximately 9°; that is, at an angle equal to the angle created by the wedge member 26.

Figure 6:
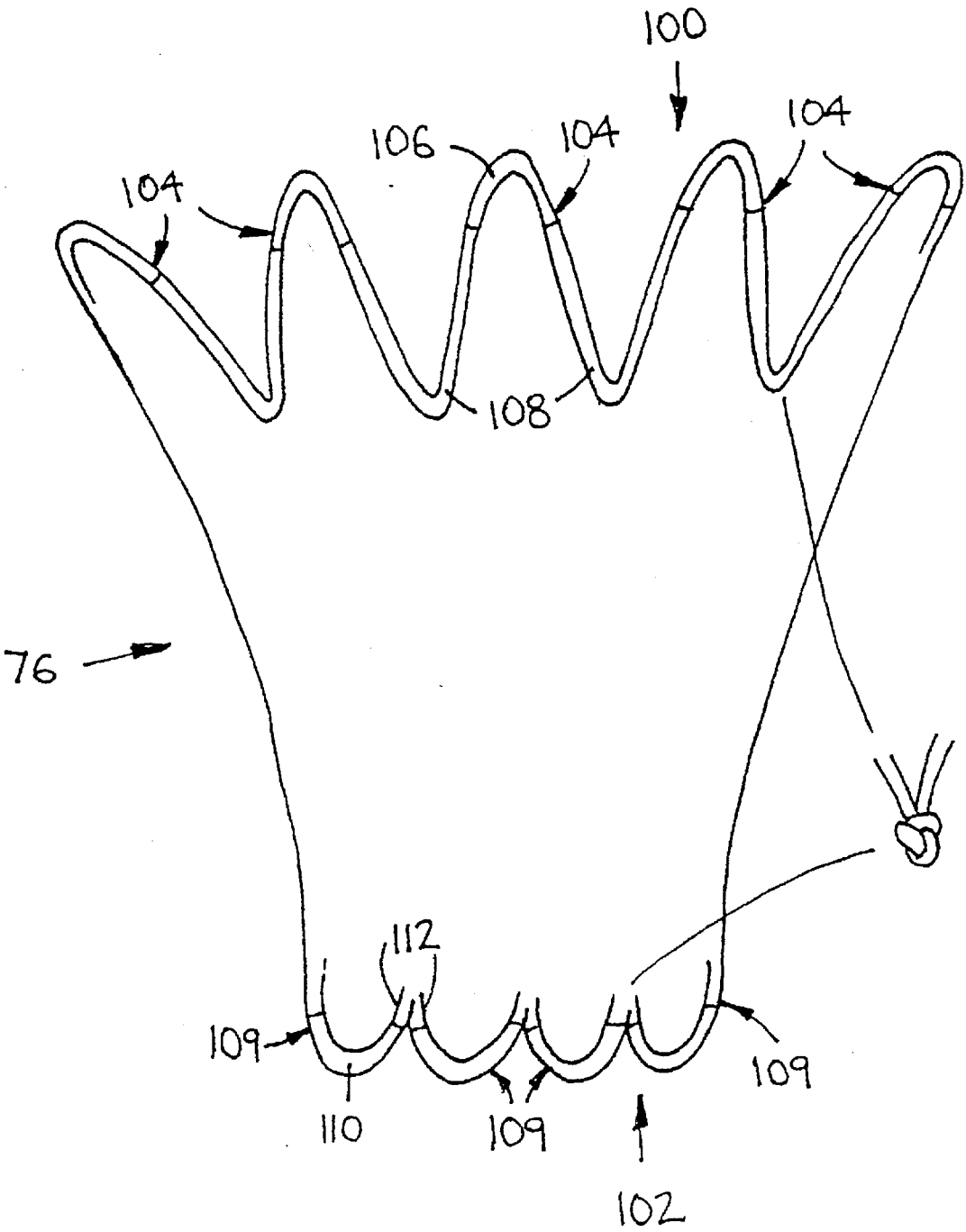

The net 76, as shown in FIG. 6, is formed of chord such as braided chord, typically of the type used in the sport of sailing. The chord is typically tied such as in a manner similar to that commonly used in the manufacture of fishing and tennis nets. Preferably, each knot in the chord is of a knot construction known as a "bowline".

The net 76 has a first end 100 and a second end 102. The net 76 tapers from the first end 100 towards the second end 102.

The first end 100 has a plurality of loops 104 each of which is applied with a high friction coating. Typically, the coating is applied by dipping the loops in molten plastic. By such the coating impregnated the chord typically up to about a half of the radius of the chord. Each of the loops 103 has a coated portion 106 and two bare portions 108. The bare potions 108 are located at the ends of the loops 104 and adjacent loops 104 are typically connected at their bare portions 108. The coated portion 106 of the loops 104 is typically curved so that the first end 100 of the net 76 hangs downwardly from the ring member 60.

The second end 102 is formed in similar manner to the first end 100, except that the loops 109 are smaller. The coated portions of the loops 107 form resilient portions 110. The loops 109 have bare portions 112 similar to the bare portions 108. The curve of the resilient portions 110 has the effect of ensuring that the size of the second end 102 is less than the size of the first end 100 when installed onto the ring member 60. Also, the sharper curve acts as a spring member in the second end 102 so that during passage of the basketball through the second end 102 the resilient portions 110 are bent to a less sharply curved shape but return to their original sharply curved shape once the basketball has passed through the second end 102. Hence, the resilience of the second end 102 of the net 76 is not dependent on the stiffness of the chord but on the coating.

In use, the basketball goal 10 is assembled and then fixed onto a basketball backboard typically by bolts fixed through the four holes 36 in the mounting plate 20. The biasing nut 90 is then adjusted to adjust the amount of bias on the springs 82 and 84. The amount of bias required depends on the amount of force which is expected to be applied by basketball players who perform "slam dunks" on the basketball goal 10, and the strength of the basketball backboard. The bias setting is typically adjusted so that the ring member 60 can deflect up to about 125 mm whilst absorbing most of the impact of the basketball player hanging from it. That is, the bias force is preferably set high enough so that the force of the basketball player hanging from the ring member 60 is not abruptly transmitted to the basketball backboard.

When used in a game of basketball a basketball player who performs a "slam dunk" grips the ring member 60 or hits the ring member 60 as he/she slams the basketball through the basketball goal 10. In so doing the force is transmitted through the bracket 62 to the pivot assembly 14. The ring assembly 16 attempts to pivot about the pivot assembly 14 under the force but is resisted by the biasing force of the biasing assembly 18. Where the force of the player exceeds the biasing force the springs 82 and 84 compress and the ring assembly 16 pivots about the pivot assembly 14. The springs 82 and 84 thus absorb some of the force of the player and continue to absorb the player's force until the springs 82 and 84 compress completely and the ring member 60 completes its pivotable travel about the pivot assembly 14. Further force from the player is then transmitted directly to the basketball backboard.

Also, during play the basket ball occasionally strike the ring member 60. The biasing force is set sufficiently high so that the force of the impact of the basketball does not cause the ring member 60 to pivot about the pivot assembly 14. Further, the impact force of the basketball, when directed at the inner circumferential sides of the ring member 60, has the effect of compressing the compressible tubes 44 and 46 which allows the ring assembly 16 to slightly wobble upon the shaft 48 without causing wear of the shaft 48. The wobble is at right angles to the axis of the shaft 48, but not radial. Due to the resilience of the tubes 44 and 46 the wobble is well damped and hence the effect of the wobble is to absorb some of the jarring force of the basketball striking the ring member 60 and avoiding wear of the pivot assembly 14. This has the preferred result that "lip out" characteristics, due to jarring of the basketball goal 10, and hence are more consistent over time avoids the increased likelihood of "lip out" which is common in deflectable basketball goals whose pivot mechanism wear over time.

Consequently the basketball goal 10 has a "feel" which is preferred by experienced basketball players.

The deflectable basketball goal 10 of the present invention has the advantage that it reduces the abruptness of the application of force to the basketball backboard from a basketball player performing a "slam dunk". Also, the goal 10 has the advantage that by the nature of the angling of the biasing assembly 18 the springs 82 and 84 are more smoothly and gradually compressed than is the case where the biasing assembly 18 is at right angles to the mounting plate 20. Further, the disposition of the braces 64 provides a more solid support for the ring member 60 whilst reducing the likelihood of "rejection" of the basketball from the basketball goal 10 due to striking of prior art type braces. In particular this is achieved by terminating the braces 64 about one third of the diametric length into the ring member 60. Still further, the more highly compressible tube 44 has the effect that the ring member 60 is allowed to wobble slightly, generally imperceptibly, so as to reduce the likelihood of "lip out" of the basketball due to jarring of the basketball goal 10.

The basketball net 76 has the advantage that the loops 100 of the first end are maintained stationary with respect to the net hangers 74 and hence wear is substantially reduced. Also, by the resilient portions 110 of the loops 109 the second end 102 of the net 76 tends not to loose its resilience and hence the net 76 has a longer serviceable life.

Modifications and variations such as would be apparent to a skilled addressee are considered within the scope of the present invention. For example, one spring could be used instead of two in the biasing assembly 18. Also, other means of achieving resilience at the second end 102 of the net 76 could be used. For example, a resilient member could be attached to or across the loops 109.

I claim:

1. A deflectable basketball goal for attachment onto a basketball backboard, the deflectable basketball goal comprising:

a ring assembly having a ring member fixed to a bracket;

a mounting means securable onto the basketball backboard for inclining the bracket at an acute angle to the vertical;

a pivot assembly disposed substantially horizontally and coupling the bracket to the mounting means for pivotally supporting the ring assembly, the pivot assembly allowing pivoting of the ring assembly between a normal use position and a deflected position; and, a biasing assembly attached between the mounting means and the bracket, the biasing assembly allowing pivoting of the ring assembly upon the mounting means against a resilient restoring force, the biasing assembly acting in a direction substantially at right angles to the angle of inclination of the bracket;

whereby, in use, load is relatively smoothly transferred from the ring assembly to the basketball backboard by the biasing assembly and the pivot assembly.

2. A deflectable basketball goal according to claim 1, in which the bracket is disposed at an angle to the vertical of between 5° to 15° so as to allow for relatively smooth actuation of the biasing assembly and hence to avoid load being abruptly transferred from the ring assembly to the basketball backboard.

3. A deflectable basketball goal-according to claim 2, in which the angle is about 9° to the vertical.

4. A deflectable basketball goal according to claim 1, in which the mounting means has a damper disposed between the bracket of the ring assembly and the basketball backboard for absorbing shock produced by pivotable return of the ring assembly about the pivot assembly from the deflected position back to the normal use position.

5. A deflectable basketball goal according to claim 4, in which the damper is made from polypropylene rubber.

6. A deflectable basketball goal according to claim 1, in which the ring assembly also has two braces disposed between the pivot assembly and the ring member, the braces extending about one third of the diametrical distance of the ring member so that the braces underlie the ring member so as to avoid fouling with a basketball.

7. A deflectable basketball ring according to claim 1, in which the biasing assembly has at least one compression spring located on a bolt between the bracket and a washer, and a nut retaining the washer on the bolt, wherein, adjustment of the nut on the bolts varies the bias of the spring so as to avoid abrupt application of load from the ring assembly to the basketball backboard.

8. A deflectable basketball goal according to claim 1, in which the pivot assembly has resilient means for allowing resilient non-axial movement of the ring member.

9. A deflectable basketball goal according to claim 8, in which the resilient pivot assembly has a shaft upon which is located a base member which is secured to the mounting means, two pivot members also located upon the shaft and secured to the ring assembly, a first compressible tube disposed between the shaft and the base member, and two second compressible tubes disposed between the shaft and the two pivot members, wherein the first compressible tube and the second compressible tubes absorb shock from the ring assembly.

10. A deflectable basketball goal according to claim 9, in which the resilient pivot assembly also has washers disposed between the compressible tubes and their respective base and pivot members so as to inhibit axial movement thereof.

* * * * *